United States Patent [19]

Antich

[11] 4,088,173

[45] May 9, 1978

[54] ANTI-FLAPPING DEVICE FOR WINDOW COVERINGS

[76] Inventor: Paul J. Antich, 32412 Vandover, St. Clair Shores, Mich. 48082

[21] Appl. No.: 753,223

[22] Filed: Dec. 22, 1976

[51] Int. Cl.[2] ..... A47G 5/02

[52] U.S. Cl. ..... 160/238; 160/178 R

[58] Field of Search ..... 160/173, 177, 178 R, 160/349 R, 384, 238; 24/255 R, 262

[56] References Cited

U.S. PATENT DOCUMENTS

| | | | |
|---|---|---|---|
| 2,236,453 | 3/1941 | Savage | 160/349 |
| 2,260,584 | 10/1941 | Schuck et al. | 24/262 R |
| 2,601,897 | 7/1952 | Winslow | 160/384 |
| 2,710,059 | 7/1955 | Wilson | 160/177 |
| 2,929,166 | 3/1960 | Sneide | 24/262 R |
| 3,159,864 | 12/1964 | Ferrera | 160/177 |
| 3,430,387 | 3/1969 | Clapham | 24/255 R |

*Primary Examiner*—Peter M. Caun
*Attorney, Agent, or Firm*—Andrew R. Basile

[57] ABSTRACT

The combination of a window covering and anti-flapping device for preventing flapping of the window covering against the window or window casing. The anti-flapping device comprises a U-shaped clip having a base and a pair of legs extending from the base. The clip is preferably fabricated from a flexible plastic material such that the inner surfaces of the clip legs are biased towards one another and are adapted to releasably engage the lower edge of a window covering, such as the lower edge or bottom hem portion of a window shade or baseboard of a venetian blind whereby the clip legs snap lockingly engage the window covering bottom edge. In one form of the invention the clip carries a resilient cushion contoured to be matingly received on the outer portion of one leg of the clip and retained there by means of a suitable adhesive. The clip is attached to the edge of the window covering such that the cushion is positioned between the clip and the window. In a second embodiment of the invention the resilient cushion is attached to the base of the clip and positioned between a venetian blind, which carries the clip, and the window. Other forms of the invention provide various means for snap lockingly securing the projecting ends of the clip legs to secure the clip to the window covering.

4 Claims, 5 Drawing Figures

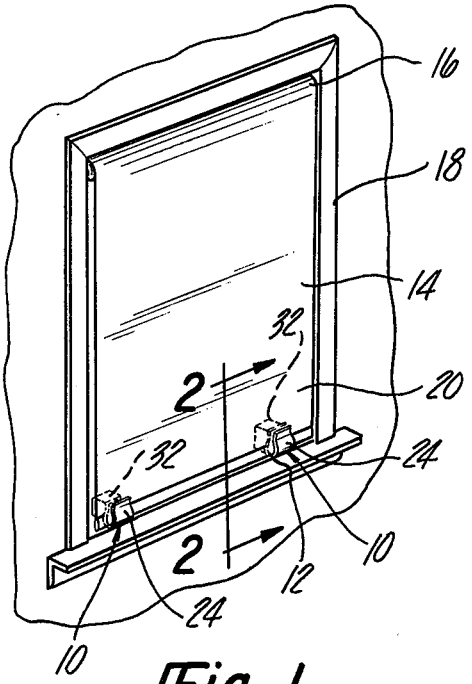
Fig-1
Fig-2
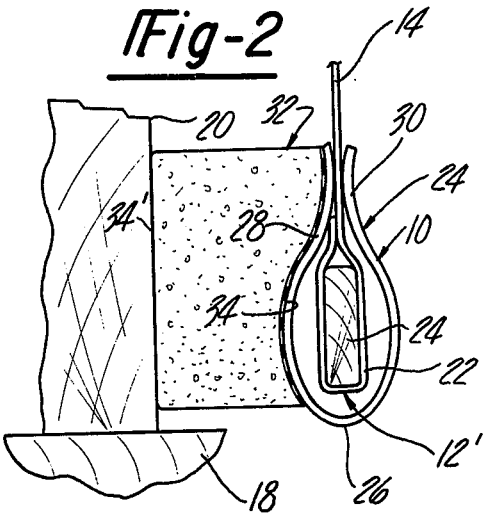
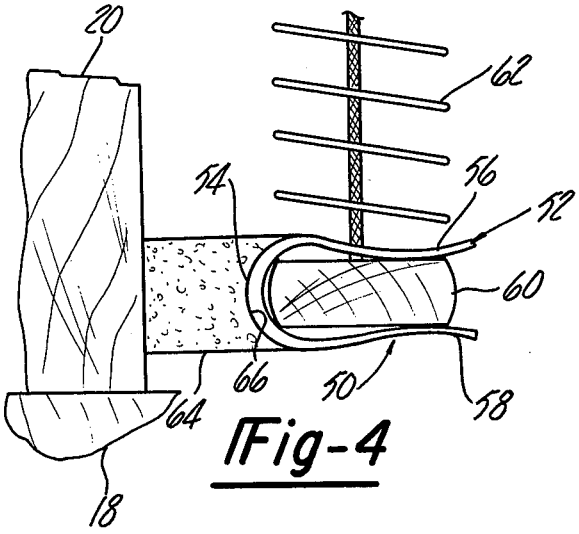
Fig-4
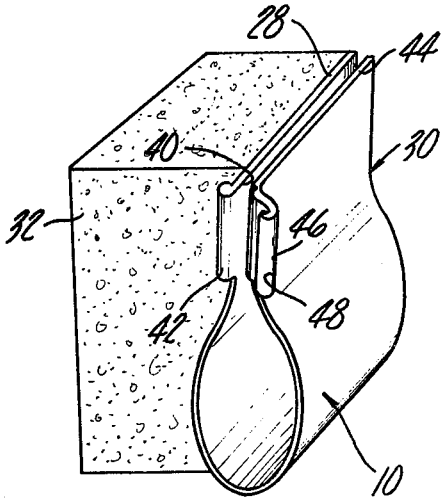
Fig-3
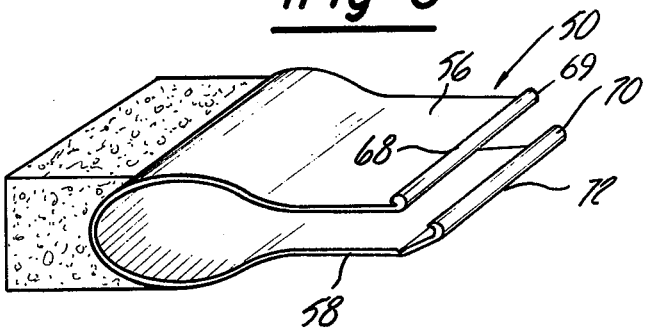
Fig-5

ANTI-FLAPPING DEVICE FOR WINDOW COVERINGS

BACKGROUND OF THE INVENTION

I. Field of the Invention

The present invention relates to a means for securing window coverings, such as window shades and venetian blinds, against flapping and damaging vibrations usually set up by the action of wind and to prevent the window covering from rattling against the window casing or window glass to eliminate the cause of annoying or disturbing distractions while a person is at rest or asleep.

II. Description of the Prior Art

Heretofore, various attempts have been made in the prior art to provide an anti-flapping device for a window covering to prevent the window covering from flapping under the action of wind or the like. An example of such prior art structures is disclosed in U.S. Pat. No. 1,997,912. This patent discloses an anti-flapping device for porch curtains and comprises a mechanical member which is spring mounted into engagement with the outside portion of a curtain in order to push the curtain against the window in which it is mounted and thereby prevent the curtain from flapping against the window under the action of the wind. This device is complicated, requires numerous mechanical components and is not attractive in its appearance, especially when used in indoor applications where appearance is of importance to the user.

It has also been suggested in the prior art that the lower end of the window covering be provided with a suitable mechanical means to fasten the lower edge of the window covering to the window irrespective of the position within which the window cover is located. An example of such a structure is disclosed in U.S. Pat. No. 2,225,436. This structure, which comprises numerous mechanical components, requires considerable modification of the window shade and is expensive in its design and structure. Other prior art structures, such as U.S. Pat. Nos. 302,616 and 3,282,328, have suggested the use of magnetic elements or the like carried by the window shade in order to position the shade or corresponding movable element in a desired position. Neither of these patents, however, recognize the desire or need for a device that will prevent flapping of a window shade. U.S. Pat. No. 2,709,107 discloses anti-rattling devices for vehicle windows wherein the device is attached to the window casing and functions to press the window against another portion of the window casing such that the window itself will not rattle.

SUMMARY OF THE INVENTION

The present invention, which will be described subsequently in greater detail, comprises the combination of a window covering and anti-flapping device for preventing flapping of the window covering against the window casing and/or glass wherein the combination comprises a window covering having an upper end attached to the casing and a freely movable lower end on which is releasably attached an anti-flapping device comprising a U-shaped clip having a base and a pair of legs extending from the base. A resilient cushion is carried by a portion of the outer surface of the clip and disposed between the clip and the window casing or glass and functions to dampen movement of the window covering with respect to the window under the action of wind and thereby eliminates unwanted noise caused by the engagement of the window covering edge with the window glass or casing.

It is therefore an object of the present invention to provide a simple and inexpensive device which is economical to make, readily installable and applied to a window covering, such as a window shade or venetian blind, which will effectively engage the window casing or glass to eliminate rattling of the window covering against the window glass.

It is also an object of the present invention to provide a combined window covering and anti-flapping device which will absorb and cushion movement of the shade under the action of wind to prevent annoying disturbances.

Other objects, advantages and applications of the present invention will become apparent to those skilled in the art of anti-flapping devices when the accompanying description of several examples of the best modes contemplated for practicing the invention are read in conjunction with the following drawing.

BRIEF DESCRIPTION OF THE DRAWING

The description herein makes reference to the accompanying drawing wherein like reference numerals refer to like parts throughout the several views, and wherein:

FIG. 1 is a perspective view of a window casing mounting a conventional window shade on which is incorporated one example of the present invention in the form of an anti-flapping clip;

FIG. 2 is a fragmentary enlarged cross-sectional view of the combined window shade and anti-flapping device taken along Line 2—2 of FIG. 1;

FIG. 3 is an enlarged perspective view of a modified form of the anti-flapping device illustrated in FIGS. 1 and 2 of the drawing;

FIG. 4 is an enlarged fragmentary cross-sectional view similar to FIG. 2 illustrating a modified form of the invention adapted to be attached to a venetian blind; and FIG. 5 is a fragmentary enlarged perspective view of a modified form of the anti-flapping clip illustrated in FIG. 4.

DESCRIPTION OF THE PREFERRED EMBODIMENT

Referring now to the drawing and, in particular, to FIGS. 1 and 2 wherein there is illustrated one example of the present invention in the form of an anti-flapping clip 10 carried on the lower edge 12 of a conventional window shade 14. The window shade 14 is of the roll type having its upper edge 16 rotatably carried via window casing 18. The window casing, in turn, mounts a glass window 20, all of which is conventional and needs no further description. As can best be seen in FIG. 2, the lower edge 12 of the window shade 14 has a looped portion 22 which supports a wooden rod 24 which, in turn, provides the user of a shade with a hard, solid portion to grasp in order to raise and lower the shade 14 in a conventional manner. As is well known to many users of such shades, when the window 20 is open, the shade 14 has a tendency to flap against the window glass 20 or the edges of the casing 18. This flapping action, due to the passage of wind through the window 20, is very annoying and disturbing and may keep a person from sleeping, resting or concentrating. This flapping action is minimized and, in certain cases, eliminated by the use of the anti-flapping device 10.

The anti-flapping device 10 comprises a U-shaped clip 24 having a base portion 26 with curved legs 28 and 30 which are made of a material that is flexible in nature, such as a plastic material or a spring metal, such that the upper opposing inner surfaces of the legs 28 and 30 are biased towards each other but may be separated such that the clip 10 may be passed over the lower edge 12 of the window shade 14 to engage the shade 14 in the manner illustrated in FIG. 2 of the drawing. The anti-flapping device 10 further comprises a cushion 32 which may be a spongy foam material that is contoured on one face 34 so as to mate with the leg 28 of the clip 24. The engaging surfaces of the cushion 22 and the leg 28 are attached to each other by any suitable means, such as an adhesive or the like. The remainder of the cushion is squared off so as to form a window engaging surface 34 which is adapted to abut the window 20 or the edge of the casing 18 such that when the wind comes through the window and raises the shade away from the window, it will cushion the reengagement of the shade with the window and thereby eliminate the distracting noises caused by a flapping window shade. As can best be seen in FIG. 1, it is preferred that two anti-flapping devices 10 be attached to the lower edge of the window shade 14 at longitudinally spaced locations and, preferably, near the side edges of the shade 14.

Referring now to FIG. 3 of the drawing, there is illustrated a modified form of the anti-flapping device 10 wherein the outer edge 40 of the clip leg 28 is provided with a bead 42, while the outer edge 44 of the clip leg 30 is provided with a pivotable flap 46, the outer edge of which is curled at 48 such that the flap may be brought around and snap lockingly engage the bead 42, whereby the clip 10 is securely fastened to the lower edge of the window shade 14. It should be understood that other forms of fastening devices may be employed for securely attaching the device 10 to the lower edge 12 of the window shade 14.

Referring now to FIG. 4 for an example of a modified form of the present invention in the form of an anti-flapping device 50 comprising a U-shaped clip 52 having a base portion 54 and legs 56 and 58, which are adapted to engage the bottom baseboard 60 of a conventional venetian blind 62. Similar to the clip 24 of the anti-flapping device 10 disclosed in FIGS. 1 and 2, the instant clip 52 is fabricated from a flexible material, such as plastic or spring metal, such that the inner surfaces of the legs 56 and 58 are biased towards each other whereby the clip 52 may releasably, but securely, engage the upper and lower surfaces of the baseboard 60. The anti-flapping device 50 further comprises a cushion 64 which has a side edge surface 66 contoured to be matingly received by the base 54. Suitable adhesive (not shown) securely attaches the cushion 64 to the base 54. It can thus be seen that when the action of wind moves the venetian blind, its abutment with the window 20 or the portions of the casing 18 will be minimized to the extent that disturbing noises described hereinbefore will be minimized or eliminated completely.

Referring now to FIG. 5 for a modified form of the clip 50, the same is illustrated as having an integral bead 68 formed along the outside longitudinal edge 69 of the leg 56, while the leg 58 is provided with an integrally formed, pivotally mounted flap 70. The flap 70 has a curved section 72 which is adapted to snap lockingly engage the bead 68 so as to enclose the venetial blind base member 60 within the clip 50 and to securely attach the anti-flapping device 50 to the venetian blind.

it can thus be seen that the present invention provides a new and improved combined window covering and anti-flapping device which prevents flapping of the window covering against the window casing or glass under the action of wind.

It should be understood that other forms of the invention may be had wherein applicant's combination may be utilized with various window coverings in addition to the window shade and/or venetian blind described herein in that it is contemplated by the inventor that ushc forms of the invention will fall within the spirit of applicant's invention and scope of the appended claims.

What is claimed is as follows:

1. The combination of a window shade and anti-flapping device for preventing flapping of the window shade against a window glass, said combination comprising:

a window shade having an upper end attached to a window casing and a freely movable lower end;

an anti-flapping device comprising a U-shaped clip having a base and a pair of open-ended, inwardly curved legs extending from said base, said clip being fabricated from a flexible plastic material such that the opposing inner surfaces of said clip legs are movable toward and away from each other and are normally biased toward each other for releasably engaging said window shade lower end to securely attach said clip thereto;

a resilient cushion carried by the outer surface of one of said clip legs and disposed between said clip and said window glass for cushioning movement of said window shade against said window glass as the window shade moves under the action of wind; and adhesive means for attaching said cushion to said outer surface portion of said one clip leg.

2. The combination defined in claim 1 wherein the surface of said cushion which is attached to the outer surface portion of said clip leg is contoured to mate.

3. The combination defined in claim 1 wherein an outer edge of one of said clip legs is provided with a bead, while the adjacent opposing edge of the other clip leg is provided with a flap, the outer edge of said flap being curved such that said flap may be pivotally moved with respect to said bead and snap lockingly engage said bead to secure said clip legs to each other.

4. The combination defined in claim 3 wherein a plurality of said anti-flapping devices are attached to the lower edge of said window shade at locations near the edge of said window covering bottom.

* * * * *